US005080518A

United States Patent [19]

Mason

[11] Patent Number: 5,080,518

[45] Date of Patent: Jan. 14, 1992

[54] DECORATIVE EARRINGS WITH ANIMAL SHAPES

[75] Inventor: Harry Mason, San Francisco, Calif.

[73] Assignee: Harry Mason, Inc., San Francisco, Calif.

[21] Appl. No.: 669,751

[22] Filed: Mar. 15, 1991

[51] Int. Cl.[5] ..... A44C 7/00

[52] U.S. Cl. ..... 63/12; 63/13; D11/11

[58] Field of Search ..... 63/3, 12, 13; D11/11, D11/49, 79; D21/154

[56] References Cited

U.S. PATENT DOCUMENTS

| | | | |
|---|---|---|---|
| 9,342 | 6/1876 | Knight . | |
| 39,136 | 2/1908 | McDonald . | |
| D. 69,510 | 2/1926 | Gould | D21/154 |
| D. 69,511 | 2/1926 | Gould | D21/154 |
| 118,378 | 1/1940 | Mann . | |
| D. 141,795 | 7/1945 | Boll | D21/154 |
| 151,325 | 10/1948 | Chernow | D45/9 |
| 151,326 | 10/1948 | Chernow | D45/9 |
| 152,864 | 3/1949 | Carlson | D34/15 |
| 159,706 | 8/1950 | Wilcox | D74/2 |
| 246,353 | 11/1977 | Elkaim | D11/8 |
| 269,769 | 7/1983 | Meyer | D11/82 |
| 269,862 | 7/1983 | Meyer | D11/82 |
| 269,863 | 7/1983 | Meyer | D11/83 |
| 301,315 | 5/1989 | Yoshida | D11/79 |
| 301,316 | 5/1989 | Yoshida | D11/79 |
| 301,317 | 5/1989 | Yoshida | D11/79 |
| 301,318 | 5/1989 | Yoshida | D11/79 |
| 301,845 | 6/1989 | Yoshida | D11/79 |
| 303,508 | 9/1989 | Yoshida | D11/79 |
| 2,797,561 | 7/1957 | Vaughn | 63/13 |
| 4,353,225 | 10/1982 | Rogers | 63/13 |

*Primary Examiner*—Gary L. Smith
*Assistant Examiner*—Jerry Redman
*Attorney, Agent, or Firm*—Limbach, Limbach & Sutton

[57] ABSTRACT

An earring device comprises an ornamental element bearing means from which at least two thin ornamental elements are hung. These ornamental elements are thin cross-sectional (x,y -axes) depictions of animals, which when arranged on the bearing means, provide a three-dimensional illusion. In a preferred embodiment, the animal head and front quarter are depicted on a first thin ornamental element, and the animal rear quarter is depicted on a second element. When hung from the bearing means, spacers are provided to create a separation between the thin ornamental elements in a z-axes. This separation creates an illusion of depth along the z-axis, leading to a three dimensional depiction of the animal.

8 Claims, 1 Drawing Sheet

DECORATIVE EARRINGS WITH ANIMAL SHAPES

TECHNICAL FIELD

The present invention relates generally to earrings and jewelry design, and more specifically, it relates to a design comprising at least two thin, two dimensional (x, y-axes) cross-sectional elements depicting portions of an animal which when assembled according to the present invention create the illusion of a segmented, three dimensional animal form in the z-axis.

BACKGROUND OF THE INVENTION

Earring design is an active field in fashion accessories. One of the themes which has been featured in numerous designs is animals. Prior art designs demonstrate that there are numerous ways in which to incorporate animal depictions into jewelry designs. For example, it is possible to use three dimensional depictions of animals, and it is also possible to use flat, two dimensional depictions. The present invention provides a hybrid between the three dimensional depiction and the two dimensional depiction. According to the present invention, the earring design comprises at least two thin flat cross-sectional elements depicting animal segments arranged along a support with intermediate spacers to create the illusion of a three dimensional animal depiction.

SUMMARY OF THE INVENTION

The decorative earring device of the present invention includes an ornamental element bearing means; at least two thin cross-sectional ornamental elements which correspond to different cross sections of an animal to be depicted in the design; spacer means for creating space between the cross-sectional elements on the bearing means to provide an illusion of three dimensions when viewing the assembled ornamental elements. Each ornamental element must have a hole through it to receive the ornamental element bearing means. The bearing means-receiving hole in the ornamental element is positioned above the center of gravity of the ornamental element to insure that the ornamental element hangs in the desired orientation when supported on a single support. In certain preferred embodiments, there are three cross-sectional ornamental elements, a first element for the head, a second for the front quarter and a third for the hind quarter.

DETAILED DESCRIPTION OF THE INVENTION

Figure 1:
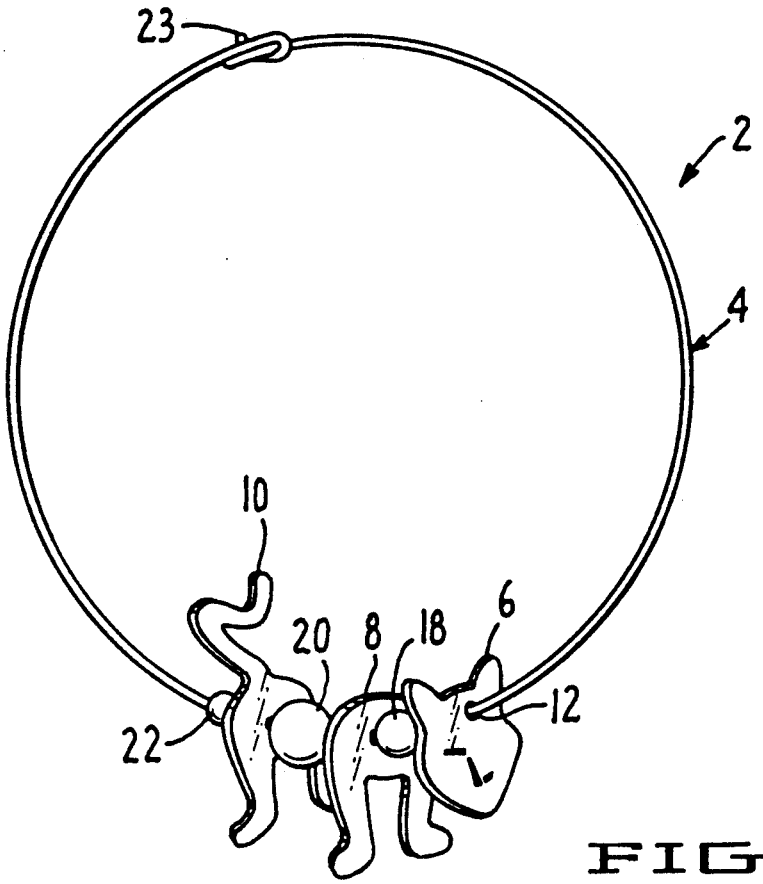
FIG. 1 is a perspective view of an earring design according to the present invention.
Figure 2A:
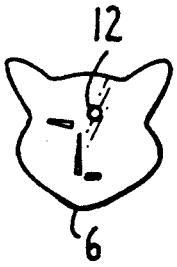
FIG. 2 is a plan view of ornamental elements according to the present design.
Figure 2B:
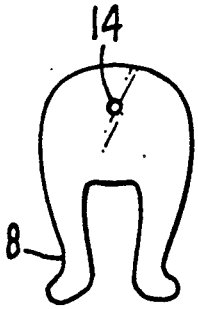
Figure 2C:
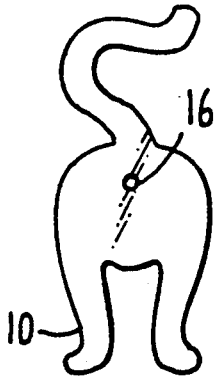

An earring 2 according to the present invention is shown in FIG. 1. In this embodiment, a metal hoop 4 is provided as the ornamental bearing means to support the ornamental elements of the earring. Hoop 4 has a 1.75 inch diameter, and is formed from 20 GA gold wire. Decorative elements 6, 8 and 10 are also shown in FIGS. 1 and 2. Element 6 is a thin metal piece depicting a two dimensional cross-sectional view of a cat's head.

Element 8 is another thin section which depicts the front quarter of the cat. Element 10 is a thin cross-sectional element depicting the rear quarter of the cat, as evidenced by the tail.

FIG. 1B shows the holes 12, 14 and 16 in the cross-sectional elements 6 through 10. These holes are adapted to receive the hoop 4 through them. In this embodiment, an 18 GA hole is provided to receive the 20 GA hoop 4. The holes 12 through 16 are positioned above the center of gravity of the elements 6 through 10. This placement insures that the ornamental elements are properly oriented when they are hung from hoop 4 such that the elements correctly align to create the desired three dimensional illusion.

When mounted upon hoop 4, the ornamental elements 6, 8 and 10 are separated by beads 18, 20 and 22. In particular, bead 18 is interpositioned between elements 6 and 8. Bead 20 is interpositioned between elements 8 and 10. In the preferred embodiment, bead 18 has a 4 mm diameter, bead 20 has a 5 mm diameter and bead 22 has a 3 mm diameter. These beads provide an expansion along the z-axis to give the resulting animal depiction greater depth in the z-axis, and to enhance the illusion of a three-dimensional animal depiction.

Figure 3:
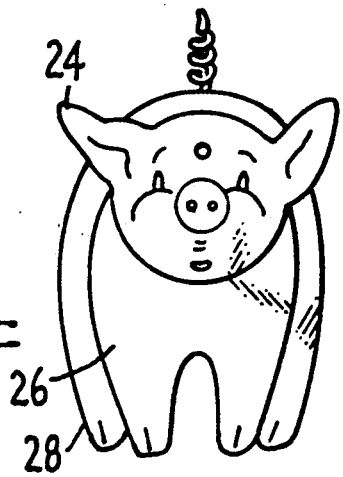
FIG. 3 is a plan view of a series of assembled ornamental elements according to the present invention.

FIG. 3 shows an alternate embodiment of the present invention depicting a pig. Element 24 depicts the pig's head. Element 26 depicts the pig's front quarter. Element 28 depicts the pig's rear quarter. Thus, when viewed along the z-axis as in FIG. 3, the pig obtains a certain dimensionality which is enhanced by spacers which are inserted between the elements 24, 26 and 28.

A variety of jewelry designs, utilizing a wide variety of animals may be constructed according to the present invention. It is possible to use as few as two ornamental elements to obtain a three dimensional depiction. In a two element embodiment, the face and front quarter would be depicted on a single element, while the rear quarter would be depicted on the second element. Of course, more than three ornamental elements may be used to create a three dimensional representation. For example, additional elements may be added in the center of the body to exaggerate the z-axis dimension to create a further illusion of depth along the z-axis. This would be particularly beneficial when depicting animals having elongated torsos, such as a lizard or snake.

The variety of animals which can be used as a basis for creating jewelry designs according to the present invention is virtually limitless. Some of the more common animals which can be depicted are cats, dogs, cows, pigs, horses, deer, squirrels, chipmunks, elephants, frogs, lions, zebras, buffalo, giraffes, monkeys, lizards, snakes and fish.

There are a large number of materials which can be used to fabricate the ornamental element supports and ornamental elements according to the present invention. For example, sterling silver, gold, niobium and platinum are among the metals most easily adapted to the fabrication of earrings according to the present invention.

As far as the application of the earring to the ear, it should be apparent to the ordinary artisan that the earrings of the present invention can be used for pierced ears. Clips and other readily commercially available fastening means can be used with ears which have not been pierced. FIG. 1 shows an embodiment for use with pierced ears, as the hoop has an opening 23 which can be passed through the pierced ear opening.

What is claimed is:

1. A decorative earring device which comprises:

a) a rigid ornamental element bearing means;

b) at least two thin cross-sectional ornamental elements having a hole passing through each of said elements, said hole adapted to receive said ornament bearing means, said hole positioned above the center of gravity of said cross-sectional element such that said cross-sectional element hangs on said ornament bearing means in a desired preselected orientation;

c) spacer means for interpositioning between said cross-sectional ornamental elements; and d) ear fastening means, wherein said thin cross-sectional ornamental elements represent x,y-axes cross sections of three dimensional animal depictions, said cross-sectional elements arranged on said ornamental element bearing means which acts as a z-axis to create a three dimensional illusion of an entire animal representation, wherein said three dimensional animal representation is selected from the group of animals consisting of cats, dogs, cows, pigs, horses, deer, squirrels, chipmunks, elephants, frogs, lions, zebras, buffalo, giraffes, monkeys, lizards, snakes and fish, and wherein said spacer means providing enhanced z-axis dimensionality.

2. The device of claim 1 wherein said ornamental element bearing means is a metal hoop.

3. The device of claim 1 wherein said spacer means are beads.

4. A decorative earring device which comprises:

a) a hoop for receiving earring ornamental elements;

b) a first thin cross-sectional ornamental element depicting the head and front quarter of an animal, said first thin element having a hole passing through it and adapted to receive said hoop, said hole positioned above the center of gravity of said first cross-sectional element such that said first cross-sectional element hangs on said hoop in the desired pre-selected orientation;

c) a second thin cross-sectional ornamental element depicting the tail and hind quarter of an animal, said second thin element having a hole passing through it and adapted to receive said hoop, said hole positioned above the center of gravity of said second cross-sectional element such that said second cross-sectional element hangs on said hoop in the desired pre-selected orientation;

d) spacer means for interpositioning between said first and second cross-sectional ornamental elements; and e) ear fastening means, wherein said first and second thin cross-sectional ornamental elements are x,y-axes cross sections of three dimensional animal depictions, said first and second cross-sectional elements arranged on said hoop which acts as a z-axis, to create an illusion of a three dimensional animal depiction, said spacer means providing enhanced z-axis dimensionality.

5. The device of claim 4 wherein said three dimensional animal representation is selected from the group of animals consisting of cats, dogs, cows, pigs, horses, deer, squirrels, chipmunks, elephants, lions, zebras, buffalo, giraffes, monkeys, lizards, snakes and fish.

6. The device of claim 4 wherein said spacer means are beads.

7. The device of claim 4 further comprising a third thin cross-sectional ornamental element depicting the mid-section of an animal, said thin third element having a hole passing through it and adapted to receive said hoop, said hole positioned above the center of gravity of said third cross-sectional element such that said third cross-sectional element hangs on said hoop in the desired pre-selected orientation.

8. A decorative earring device which comprises:

a) a hoop for receiving earring ornaments;

b) a first thin cross-sectional ornamental element depicting the head of an animal, said first thin element having a hole passing through it and adapted to receive said hoop, said hole positioned above the center of gravity of said first cross-sectional element such that said first cross-sectional element hangs on said hoop in the desired pre-selected orientation;

c) a second thin cross-sectional ornamental element depicting the front quarter of an animal, said second thin element having a hole passing through it and adapted to receive said hoop, said hole positioned above the center of gravity of said second cross-sectional element such that said second cross-sectional element hangs on said hoop in the desired pre-selected orientation;

d) a third thin cross-sectional ornamental element depicting the rear quarter of an animal, said third element having a hole passing through it and adapted to receive said hoop, said hole positioned above the center of gravity of said third cross-sectional element such that said third cross-sectional element hangs on said hoop in the desired pre-selected orientation;

e) spacer means for interpositioning between said first, second and third cross-sectional ornamental elements; and f) ear fastening means, wherein said first, second and third thin cross-sectional ornamental elements represent x,y-axes cross sections of three dimensional animal depictions, said cross-sectional elements arranged on said hoop, which acts as a z-axis, to create an illusion of a three dimensional animal depiction, said spacer means providing enhanced z-axis dimensionality.

* * * * *